US009017914B2

(12) United States Patent
Tanaka

(10) Patent No.: US 9,017,914 B2
(45) Date of Patent: Apr. 28, 2015

(54) TONER FOR DEVELOPING ELECTROSTATIC LATENT IMAGE

(75) Inventor: Takanori Tanaka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 13/437,364

(22) Filed: Apr. 2, 2012

(65) Prior Publication Data

US 2012/0258395 A1 Oct. 11, 2012

(30) Foreign Application Priority Data

Apr. 5, 2011 (JP) ..... 2011-083929
Mar. 7, 2012 (JP) ..... 2012-050789

(51) Int. Cl.
*G03G 9/08* (2006.01)

(52) U.S. Cl.
CPC ..... *G03G 9/0819* (2013.01); *G03G 9/081* (2013.01); *G03G 9/0815* (2013.01); *G03G 9/0827* (2013.01)

(58) Field of Classification Search
CPC . G03G 9/0819; G03G 9/0825; G03G 9/0827; G03G 9/08
USPC ..... 430/110.3, 110.4, 110.1
See application file for complete search history.

(56) References Cited

U.S. PATENT DOCUMENTS

| | | | | |
|---|---|---|---|---|
| 6,346,356 | B1 | 2/2002 | Ohno et al. | |
| 2005/0042535 | A1 * | 2/2005 | Vanbesien et al. | 430/110.3 |
| 2008/0063967 | A1 * | 3/2008 | Shin et al. | 430/109.3 |
| 2008/0145780 | A1 * | 6/2008 | Yang et al. | 430/137.14 |
| 2009/0142093 | A1 | 6/2009 | Sawada et al. | |
| 2010/0124717 | A1 | 5/2010 | Nakajima et al. | |
| 2010/0159385 | A1 | 6/2010 | Yang | |

FOREIGN PATENT DOCUMENTS

| | | | |
|---|---|---|---|
| EP | 1939693 | A2 | 7/2008 |
| JP | 2006-163302 | A | 6/2006 |
| JP | 2009-134079 | | 6/2009 |

OTHER PUBLICATIONS

European Patent Office Extended European Search Report and Opinion mailed Jun. 6, 2012 in corresponding EP Application No. 12162818.4.

* cited by examiner

*Primary Examiner* — Peter Vajda
*Assistant Examiner* — Olatunji Godo
(74) *Attorney, Agent, or Firm* — Frommer Lawrence & Haug LLP

(57) ABSTRACT

A toner for developing an electrostatic latent image includes toner particles. An average aspect ratio of the toner particles, having predetermined diameters of at least 3 μm and less than 10 μm, is in the range from about 0.820 to about 0.900, and the difference between the maximum value and minimum value among the average aspect ratios D3, D4, D5, D6, D7, D8, and D9 is up to 0.07. Dn represents an average aspect ratio of those toner particles having a diameter of at least n μm and less than n+1 μm.

7 Claims, 1 Drawing Sheet

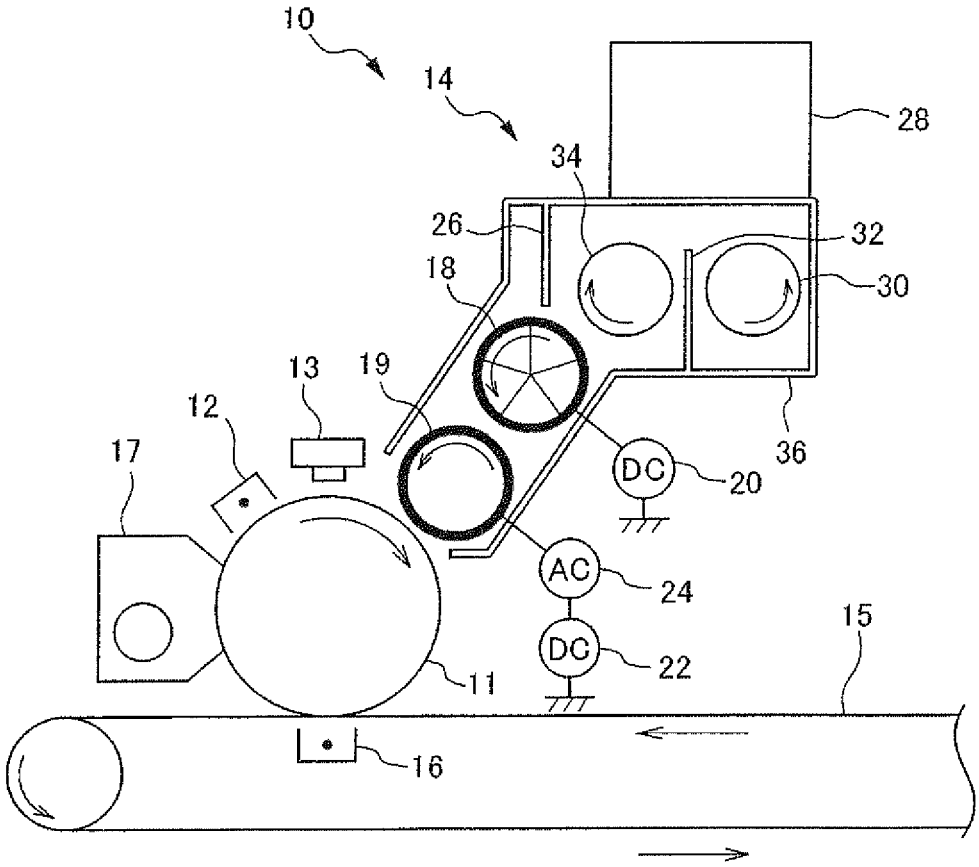
10
14
28
34
26
32
18
30
13
19
12
17
DC
20
36
AC
24
DC
22
15
11
16

TONER FOR DEVELOPING ELECTROSTATIC LATENT IMAGE

INCORPORATION BY REFERENCE

This application is based upon and claims the benefit of priority from the corresponding Japanese Patent application No. 2011-083929, filed Apr. 5, 2011, and Japanese Patent application No. 2012-050789, filed Mar. 7, 2012, the entire contents of which are incorporated herein by reference.

FIELD

The present disclosure relates to a toner for developing an electrostatic latent image.

BACKGROUND

In general, in an electrophotographic technique or an electrostatic recording technique, a latent image bearing member, which is in the form of a photoconductor or a dielectric, is charged by corona charging or another process. The charged latent image bearing member is exposed by using a laser or a light emitting diode (LED), thereby forming an electrostatic latent image on the latent image bearing member. The formed electrostatic latent image is visualized by, for example, reversal development using a developer such as a toner, so that a high-quality image is formed. In general, a toner used in such a development method is produced through the following processes: mixing a thermoplastic resin as a binder with a colorant, dye as a charge-controlling agent, pigment, and a releasing agent; and processing the mixture into particles having an average particle diameter of 5 μm or more and 15 μm or less through, for instance, kneading, pulverizing, or classifying. Fine particles such as silica or titanium oxide are typically added to toner base particles for the following purposes: imparting flowability to the toner, controlling electrostatic charge of the toner, and enhancing the cleanablity of the toner from the latent image bearing member.

To enhance image quality, the diameter of such toner particles has been reduced. The toner particles having small diameter, such as particles having a diameter smaller than 7 μm, improve the reproducibility of fine lines.

The toner particles with small diameter often contain ultrafine powder having a particle diameter of 3 μm or less. In the case where the toner contains the ultrafine powder having a particle diameter of 3 μm or less, the ultrafine powder may contaminate a developing sleeve. In other words, although the toner is supplied from the developing sleeve to a photoconductor in the developing process, the ultrafine powder may not be supplied onto the photoconductor and stay on the developing sleeve. The ultrafine powder has strong adhesiveness to the developing sleeve. If the ultrafine powder is repeatedly left on the developing sleeve in the developing process, more and more ultrafine powder having strong adhesiveness remains on the developing sleeve. When a thin layer of the toner containing the ultrafine powder is formed on the surface of the developing sleeve, developability may be decreased.

When printing is performed for a long period of time, the ultrafine powder contained in the toner may also adhere onto a surface of a carrier and may cause toner spent. In long-term use of the toner with the ultrafine powder, such problems as fogging in formed images and scattering of the toner from a developing device may be therefore easily caused. Such problems caused by the toner with the ultrafine powders can frequently occur in use of a pulverized toner which is produced as a result of melt-blending a binder resin with other components such as a colorant, releasing agent, and charge-controlling agent and then pulverizing and classifying the resultant mixture.

In addition, the toner particles having a small diameter may pass through a device for removing a residual toner, such as an elastic blade, in a cleaning portion. The residual toner which has passed through the cleaning device may cause a defective image.

In order to overcome the above problems brought by the pulverized toner with particles having a small diameter, for example, a technique has been proposed, in which toner particles with an aspect ratio of 0.8 or more and 0.9 or less are used to form images.

However, even if the toner particles with an aspect ratio of 0.8 or more and 0.9 or less are used, contamination of the developing sleeve and toner spent on a carrier may still be caused. Even if an average aspect ratio of the toner particles is, for example, 0.8 or more and 0.9 or less as a whole, particles of the toner within a certain diameter range may have a smaller aspect ratio. In this case, the particles with a smaller aspect ratio may strongly adhere to the developing sleeve and carrier with its plane parallel to the long axis of the particles. In the case where the particles with a smaller aspect ratio adhere to the latent image bearing member with its plane parallel to the long axis of the particles, the particles may pass through a device for cleaning a residual toner, particularly in a process of cleaning a residual toner.

Moreover, the particles with a smaller aspect ratio have difficulty to be removed from the latent image bearing member (photoconductive drum). A dropout is therefore likely caused in a process of transferring a toner image from the latent image bearing member, with the result that a defective image is formed. The dropout refers to a phenomenon of a defective image in which part of the center of a thin line is not transferred in the transfer process and a formed image has reduced image density at a portion corresponding to the center of the thin line as compared with the image density around the defective area.

SUMMARY

An aspect of some embodiments of the present disclosure provides a toner for developing an electrostatic latent image in which the occurrence of a dropout in a process of transferring a toner image from a latent image bearing member is reduced and the formation of a defective image caused by pass-through of toner in a process of cleaning a residual toner is reduced.

A toner for developing an electrostatic latent image according to an aspect of some embodiments of the present disclosure includes toner particles. An average aspect ratio of the toner particles having the diameter of at least 3 μm and less than 10 μm is in a range of about 0.820 or more and about 0.900 or less. The difference between a maximum value and a minimum value among the average aspect ratios D3, D4, D5, D6, D7, D8, and D9 is up to about 0.07, Dn representing an average aspect ratio of those toner particles having diameters of at least about n μm and less than about n+1 μm.

The above and other objects, features, and advantages of various embodiments of the present disclosure will be more apparent from the following detailed description of embodiments taken in conjunction with the accompanying drawings.

Throughout the specification and claims, the following terms take at least the meanings explicitly associated herein, unless the context dictates otherwise. The meanings identified below do not necessarily limit the terms, but merely provide illustrative examples for the terms. In the text, the terms is "comprising", "comprise", "comprises" and other forms of "comprise" can have the meaning ascribed to these terms in U.S. Patent Law and can mean "including", "include", "includes" and other forms of "include." The term "contains" or other forms thereof, as used herein, is synonymous with "comprises" or "includes"; it is similarly inclusive or open-ended and does not exclude additional, unrecited elements or steps. The term "composed" or other forms thereof, as used herein, denotes that some embodiments or implementations may exclude unspecified materials, compounds, elements, components, or the like (e.g., other than, for example, impurities, trace compounds, or the like), and that some embodiments may not exclude other unspecified materials, compounds, elements, components, or the like; for example, other unspecified materials, compounds, elements, may be included provided they do not adversely affect the desired characteristics of the specified material, compound, element, component, or the like, or otherwise do not materially alter the basic and novel characteristics of the embodiment or implementation. The phrase "an embodiment" as used herein does not necessarily refer to the same embodiment, though it may. In addition, the meaning of "a," "an," and "the" include plural references; thus, for example, "an embodiment" is not limited to a single embodiment but refers to one or more embodiments. As used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise.

It will be appreciated by those skilled in the art that the foregoing brief description and the following detailed description are exemplary (i.e., illustrative) and explanatory of the subject matter of the present disclosure, but are not intended to be restrictive thereof or limiting the advantages which can be achieved by the present disclosure in various implementations. Additionally, it is understood that the foregoing summary and ensuing detailed description are representative of some embodiments of the present disclosure, and are neither representative nor inclusive of all subject matter and embodiments within the scope of the present disclosure. Thus, the accompanying drawings, referred to herein and constituting a part hereof, illustrate embodiments of this disclosure, and, together with the detailed description, serve to explain principles of embodiments of the present disclosure.

Various features of novelty which characterize various aspects of the disclosure are pointed out in particularity in the claims annexed to and forming a part of this disclosure. For a better understanding of the disclosure, operating advantages and specific objects that may be attained by some of its uses, reference is made to the accompanying descriptive matter in which exemplary embodiments of the disclosure are illustrated in the accompanying drawings in which corresponding components are identified by the same reference numerals.

BRIEF DESCRIPTION OF THE DRAWING

The following detailed description, given by way of example, but not intended to limit the disclosure solely to the specific embodiments described, may best be understood in conjunction with the accompanying drawing, in which:

FIG. 1 illustrates the configuration of an example of an image-forming apparatus.

DETAILED DESCRIPTION OF EMBODIMENTS

Reference will now be made in detail to various embodiments of the disclosure, one or more examples of which are illustrated in the accompanying drawings. Each example is provided by way of explanation of the disclosure, and by no way limiting the present disclosure. In fact, it will be apparent to those skilled in the art that various modifications, combinations, additions, deletions and variations can be made in the present disclosure without departing from the scope or spirit of the present disclosure. For instance, features illustrated or described as part of one embodiment can be used in another embodiment to yield a still further embodiment. It is intended that the present disclosure covers such modifications, combinations, additions, deletions, applications and variations that come within the scope of the appended claims and their equivalents. It will also be understood that reference to a "first embodiment" and a "second embodiment" is simply for ease of reference, and does not indicate that only these embodiments are with the scope of the present disclosure, nor that these embodiments are mutually exclusive. For example, those skilled in the art will understand that each of the first and second embodiments may be modified according to one or more features of the other embodiment, and further that various features of each embodiment may be used to provide yet further embodiments.

A toner for developing an electrostatic latent image according to an aspect of some embodiments of the present disclosure (hereinafter simply referred to as "toner", where appropriate) includes toner particles. An average aspect ratio of the toner particles having diameters of at least 3 μm and less than 10 μm is in the range of 0.820 or more and 0.900 or less. The difference between a maximum value and a minimum value among the average aspect ratios D3, D4, D5, D6, D7, D8, and D9 is up to about 0.07, Dn representing an average aspect ratio of those toner particles having diameters of at least about n μm and less than about n+1 μm. In the toner for developing an electrostatic latent image according to an aspect of some embodiments of the present disclosure, an external additive is optionally attached onto a surface of toner base particles produced as a result of mixing a binder resin with various components (individual particles to which the external additive has not been attached may be referred to as "toner base particles", and individual particles to which the external additive has been attached may be referred to as "toner particles"). Types of the toner base particles are not specifically limited without departing from the scope of the present disclosure. A substance produced as a result of mixing a binder resin with a charge-controlling agent and a releasing agent is typically employed. The toner base particles may appropriately contain other components such as colorant and magnetic powder. In addition, the toner for developing an electrostatic latent image according to an aspect of some embodiments of the present disclosure may be optionally mixed with a carrier and used as a two-component developer for developing an electrostatic latent image.

Descriptions of various aspects of the present disclosure are made in the following sequence: a binder resin, a colorant, a charge-controlling agent, a releasing agent, magnetic powder, a carrier, a method for producing the toner for developing an electrostatic latent image, and a method for forming an image by using the toner for developing an electrostatic latent image.

Any type of resin that may be used as a binder resin for traditional toner particles can be used as the binder resin contained in the toner particles of the present disclosure. Specific examples of the binder resin include thermoplastic resins such as styrene resin, acryl resin, styrene-acryl resin, polyethylene resin, polypropylene resin, vinyl chloride resin, polyester resin, polyamide resin, polyurethane resin, polyvinyl alcohol resin, vinyl ether resin, N-vinyl resin, and styrenebutadiene resin. Among these resins, in view of the dispersibility of a colorant in the toner, the electrostatic properties of the toner, and fixing properties to paper, preferred options are polystyrene resin and polyester resin. The polystyrene resin and polyester resin are hereinafter described.

The polystyrene resin to be used may be homopolymers of styrene or copolymers with other copolymerizable monomers which can be copolymerized with styrene. Examples of the copolymerizable monomers which can be copolymerized with styrene include p-chlorostyrene; vinylnaphthalene; ethylenically unsaturated monoolefins such as ethylene, propylene, butylene, and isobutylene; vinyl halides such as vinyl chloride, vinyl bromide, and vinyl fluoride; vinyl esters such as vinyl acetate, vinyl propionate, vinyl benzoate, and vinyl butyrate; (meth)acrylic acid esters such as methyl acrylate, ethyl acrylate, n-butyl acrylate, isobutyl acrylate, dodecyl acrylate, n-octyl acrylate, 2-chloroethyl acrylate, phenyl acrylate, α-methyl chloroacrylate, methyl methacrylate, ethyl methacrylate, and butyl methacrylate; other acrylic acid derivatives such as acrylonitrile, methacrylonitrile, and acrylamide; vinyl ethers such as vinyl methyl ether and vinyl isobutyl ether; vinyl ketones such as methyl vinyl ketone, ethyl vinyl ketone, and methyl isopropenyl ketone; and N-vinyl compounds such as N-vinylpyrrole, N-vinylcarbazole, N-vinylindole, and N-vinylpyrrolidone. These copolymerizable monomers may be used in combination for copolymerization with a styrene monomer.

The polyester resin to be used may be compounds produced as a result of polycondensation or copolycondensation of di-, tri-, or polyhydric alcohol components with di-, tri-, or polycarboxylic acid components. The following alcohol components or carboxylic acid components may be used for synthesis of the polyester resin.

Specific examples of the di-, tri-, or polyhydric alcohol components include diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, and polytetramethylene glycol; bisphenols such as bisphenol A, hydrogenated bisphenol A, polyoxyethylenated bisphenol A, and polyoxypropylenated bisphenol A; and tri- or polyhydric alcohols such as sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Specific examples of the di-, tri-, or polycarboxylic acid components include dihydric carboxylic acids, for example, such as maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, or alkyl or alkenyl succinic acids such as n-butylsuccinic acid, n-butenylsuccinic acid, isobutylsuccinic acid, isobutenylsuccinic acid, n-octylsuccinic acid, n-octenylsuccinic acid, n-dodecylsuccinic acid, n-dodecenylsuccinic acid, isododecylsuccinic acid, and isododecenylsuccinic acid; and tri- or polyhydric carboxylic acids such as 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and enpol trimer acid. The di-, tri-, or polycarboxylic acid components to be used may be ester-forming derivatives of acid halides, acid anhydrides, or lower alkyl esters. The term "lower alkyl" means alkyl groups having one to six carbon atoms.

In the case of using polyester resin as the binder resin, the polyester resin has a softening point that is preferably in the range from 80° C. to 150° C., and more preferably in the range from 90° C. to 140° C.

Thermoplastic resins have good fixing properties and are therefore preferably used as the binder resin. The thermoplastic resins may be used alone or in combination with a cross linker and thermosetting resins. A cross-linked structure is partially introduced into the binder resin, thereby being able to enhance the preservation stability, shape retention, and durability of the toner without decrease in the fixing properties of the toner.

Epoxy resin and cyanate resin are preferably used as the thermosetting resins used in combination with the thermoplastic resins. Examples of preferred thermosetting resins include bisphenol A epoxy resin, hydrogenated bisphenol A epoxy resin, novolac epoxy resin, polyalkylene ether-type epoxy resin, cyclic aliphatic epoxy resin, and cyanate resin. These thermosetting resins may be used in combination.

The glass transition temperature (Tg) of the binder resin is preferably in the range from 50° C. to 65° C., more preferably in the range from 50° C. to 60° C. In the case where the binder resin has an excessively low glass transition temperature, the toner particles may be fused together inside a developing portion of an image-forming apparatus, and the preservation stability of the toner is decreased with the result that the toner particles may be partially fused together during transportation of a toner container or preservation in a store house. In the case where the binder resin has an excessively high glass transition temperature, the strength of the binder resin is decreased with the result that the toner is likely to easily adhere to a latent image bearing member. In such a case, a toner is less likely to be satisfactorily fixed at a low temperature.

The glass transition temperature of the binder resin can be determined from the changing temperature of specific heat with a differential scanning calorimeter (DSC). In particular, the glass transition temperature of the binder resin can be determined as a result of analyzing an endothermic curve with a differential scanning calorimeter DSC-6200 manufactured by Seiko Instruments Inc. In an aluminum pan, 10 mg of the binder resin as a measuring sample is placed. An empty aluminum pan is prepared as a reference. The analysis is conducted at a measuring temperature ranging from 25° C. to 200° C. and a temperature raising rate of 10° C./min under a normal ambient temperature and normal ambient humidity, and the glass transition temperature can be determined from the resulting endothermic curve.

The toner for developing an electrostatic latent image according to an aspect of some embodiments of the present disclosure may appropriately include a colorant to be mixed with the binder resin. Various known pigments and dyes can be used as the colorant included in the toner for developing an electrostatic latent image, depending on the intended color of toner particles. Specific examples of preferred colorants to be contained in the toner include: black pigments such as carbon black, acetylene black, lamp black, and aniline black; yellow pigments such as chrome yellow, zinc yellow, cadmium yellow, yellow iron oxide, mineral fast yellow, nickel titanium yellow, naples yellow, naphthol yellow S, Hansa yellow G, Hansa yellow 10G, benzidine yellow G, benzidine yellow GR, quinoline yellow lake, permanent yellow NCG, and tartrazine lake; orange pigments such as chrome orange, molybdenum orange, permanent orange GTR, pyrazolone orange, vulcan orange, and indanthrene brilliant orange GK; red pigments such as colcothar, cadmium red, red lead, cadmium mercury sulfide, permanent red 4R, lithol red, pyrazolone red, Watchung Red calcium salt, lake red D, brilliant carmine 6B, eosin lake, rhodamine lake B, alizarin lake, and brilliant carmine 3B; purple pigments such as manganese violet, fast violet B, and methyl violet lake; blue pigments such as iron blue, cobalt blue, alkali blue lake, partially chlorinated victoria blue, fast sky blue, and indanthrene blue BC; green pigments such as chromium green, chromium oxide, pigment green B, malachite green lake, and final yellow green G; white pigments such as zinc white, titanium oxide, antimony white, and zinc sulfide; and extender pigments such as barite powder, barium carbonate, clay, silica, white carbon, talc, and alumina white. These colorants may be used in combination in order to impart a specific color phase to the toner.

The amount of the colorant to be used is not specifically limited within the scope of the present disclosure. In particular, the amount of the colorant to be used is in the range from about 1 to about 10 parts by weight, more preferably in the range from about 3 to about 7 parts by weight with respect to 100 parts by weight of the binder resin.

The toner for developing an electrostatic latent image includes a charge-controlling agent to be mixed with the binder resin. The charge-controlling agent enhances the stability of the charging level of the toner and the charge rise characteristics which indicate possibility to charge the toner to a certain charging level in a short time. The charge-controlling agent is therefore used to provide a toner having excellent durability and stability. A positively charged charge-controlling agent is used in the case of positively charging the toner for development, and a negatively charged charge-controlling agent is used in the case of negatively charging the toner for development.

Types of the charge-controlling agent are not specifically limited within the scope of the present disclosure and may be appropriately selected from the group including charge-controlling agents traditionally used for a toner. Specific examples of the positively charged charge-controlling agent include azine compounds such as pyridazine, pyrimidine, pyrazine, ortho-oxazine, meta-oxazine, para-oxazine, ortho-thiazine, meta-thiazine, para-thiazine, 1,2,3-triazine, 1,2,4-triazine, 1,3,5-triazine, 1,2,4-oxadiazine, 3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; direct dyes composed of azine compounds such as azine fast red FC, azine fast red 12BK, azine violet BO, azine brown 3G, azine light brown GR, azine dark green BH/C, azine deep black EW, and azine deep black 3RL; nigrosine compounds such as nigrosine, nigrosine salts, and nigrosine derivatives; nigrosine compound-based acidic dyes such as nigrosine BK, nigrosine NB, and nigrosine Z; metal salts of naphthenic acid and higher fatty acids; alkoxylated amines; alkyl amides; and quaternary ammonium salts such as benzylmethylhexyldecyl ammonium and decyltrimethylammonium chlorides. Among these positively charged charge-controlling agents, the nigrosine compounds enable quick charge rise and are therefore preferably employed. The positively charged charge-controlling agents can be used in combination.

Resins having a quaternary ammonium salt, carboxylate, or a carboxyl group as a functional group may be used as the positively charged charge-controlling agent. In particular, examples of such resins include styrene resin having a quaternary ammonium salt, acrylic resin having a quaternary ammonium salt, styrene-acrylic resin having a quaternary ammonium salt, polyester resin having a quaternary ammonium salt, styrene resin having carboxylate, acrylic resin having carboxylate, styrene-acrylic resin having carboxylate, polyester resin having carboxylate, polystyrene resin having a carboxyl group, acrylic resin having a carboxyl group, styrene-acrylic resin having a carboxyl group, and polyester resin having a carboxyl group. These resins may be used alone or in combination. The molecular weight of these resins is not specifically limited without departing from the scope of the present disclosure, and these resins may be oligomer or polymer.

Among the resins which can be used as the positively charged charge-controlling agent, a styrene-acrylic copolymerizable resin having a quaternary ammonium salt as a functional group is preferably employed because the charged amount can be easily adjusted within a desired range. In the styrene-acrylic copolymerizable resin having a quaternary ammonium salt as a functional group, specific examples of preferred acrylic comonomer to be copolymerized with a styrene unit include (meth)acrylic acid alkyl esters such as methyl acrylate, ethyl acrylate, n-propyl acrylate, iso-propyl acrylate, n-butyl acrylate, iso-butyl acrylate, 2-ethylhexyl acrylate, methyl methacrylate, ethyl methacrylate, n-butyl methacrylate, and iso-butyl methacrylate.

A unit derived from dialkylaminoalkyl(meth)acrylate, dialkyl(meth)acrylamide, or dialkylaminoalkyl(meth)acrylamide through a quaternization process is used as the quaternary ammonium salt. Specific examples of dialkylaminoalkyl (meth)acrylate include dimethylaminoethyl(meth)acrylate, diethylaminoethyl(meth)acrylate, dipropylaminoethyl (meth)acrylate, and dibutylaminoethyl(meth)acrylate. Specific examples of dialkyl(meth)acrylamide include dimethyl methacrylamide. Specific examples of dialkylaminoalkyl (meth)acrylamide include dimethylaminopropyl methacrylamide. Hydroxy group-containing polymerizable monomers, such as hydroxyethyl(meth)acrylate, hydroxypropyl (meth) acrylate, 2-hydroxybutyl(meth)acrylate, and N-methylol (meth)acrylamide, may be used in combination on polymerization.

Specific examples of the negatively charged charge-controlling agent include organometallic complexes and chelate compounds. Examples of preferred organometallic complexes and chelate compounds include acetylacetonate metal complexes, such as aluminum acetylacetonate and iron (II) acetylacetonate, and salicylic acid metal complexes or salicylic acid metal salts such as 3,5-di-tert-butylsalicylic acid chromium. More preferred are salicylic acid metal complexes or salicylic acid metal salts. These negatively charged charge-controlling agents may be used in combination.

The amount of the positively or negatively charged charge-controlling agent to be used is not specifically limited without departing from the scope of the present disclosure. The typical amount of the positively or negatively charged charge-controlling agent to be used is preferably in the range from about 1.5 to about 15 parts by weight, more preferably about 2.0 to about 8.0 parts by weight, and particularly preferably about 3.0 to about 7.0 parts by weight with respect to 100 parts by weight of the toner. In the case where the amount of the charge-controlling agent to be used is excessively small, the toner is less likely to be stably charged to a specific polarity, and problems may be therefore caused, in which the image density of a formed image falls below an intended level and maintaining the image density for a long term becomes difficult. Furthermore, the charge-controlling agent is less likely to be uniformly dispersed in the toner, and problems may be therefore caused, in which fogging of formed images frequently occurs and a latent image bearing member is readily contaminated. In the case where the amount of the charge-controlling agent to be used is excessively large, formation of a defective image and contamination of the latent image bearing member are readily caused by defective charging under conditions of high temperature and humidity due to the decrease of environment resistance.

The toner for developing an electrostatic latent image according to an aspect of some embodiments of the present disclosure includes the releasing agent to enhance fixing properties and anti-offset properties. Types of the releasing agent to be contained in the toner are not specifically limited within the scope of the present disclosure. Wax is preferably used as the releasing agent. Specific examples of the wax include polyethylene wax, polypropylene wax, fluororesin wax, Fisher-Tropsch wax, paraffin wax, ester wax, montan wax, and rice wax. These releasing agents may be used in combination. Addition of the releasing agent to the toner effectively reduces the occurrence of toner offset and image smearing (stain caused around an image by grabbing the image).

The amount of the releasing agent to be used is not specifically limited without departing from the scope of the present disclosure. In particular, the amount of the releasing agent to be used is preferably in the range from about 1 to about 5 parts by weight with respect to 100 parts by weight of the binder resin. In the case where the amount of the releasing agent is excessively small, intended effects may not be provided in the reduction of the occurrence of toner offset and image smearing in a formed image. In the case where the amount of the releasing agent is excessively large, the toner particles may be fused together with the result that the preservation stability of the toner is decreased.

The toner for developing an electrostatic latent image according to an aspect of some embodiments of the present disclosure may optionally include magnetic powder to be mixed with the binder resin. Types of the magnetic powder contained in the toner are not specifically limited without departing from the scope of the present disclosure. Examples of preferred magnetic powder include iron materials such as ferrite and magnetite; ferromagnetic metal such as cobalt and nickel; alloys containing iron and/or ferromagnetic metal; compounds containing iron and/or ferromagnetic metal; ferromagnetic alloys subjected to treatment to impart ferromagnetic properties, such as heat treatment; and chromium dioxide.

The particle diameter of the magnetic powder is not specifically limited within the scope of the present disclosure. In particular, the magnetic powder has a particle diameter that is preferably in the range from about 0.1 μm to about 1.0 μm, more preferably in the range from about 0.1 μm to about 0.5 μm. The particle diameter within these ranges helps the magnetic powder to be uniformly dispersed in the binder resin.

In order to improve the dispersibility of the magnetic powder in the binder resin, the magnetic powder to be used may be subjected to a surface treatment using a surface-treating agent such as a titanium coupling agent or a silane coupling agent.

The amount of the magnetic powder to be used is not specifically limited without departing from the scope of the present disclosure. In particular, in the case of using the toner as a one-component developer, the amount of the magnetic powder to be used is preferably in the range from about 35 to about 60 parts by weight, more preferably in the range from about 40 to about 60 parts by weight with respect to 100 parts by weight of the toner. In the case where the amount of the magnetic powder to be used is excessively large, the image density may fall below an intended level in long-term printing, and fixing properties may be significantly decreased. In the case where the amount of the magnetic powder to be used is excessively small, fogging of formed images may frequently occur, and an image density may fall below an intended level in long-term printing. In the case of using the toner as a two-component developer, the amount of the magnetic powder to be used is preferably about 20 parts by weight or lower, more preferably about 15 parts by weight or lower with respect to 100 parts by weight of the toner.

In the toner for developing an electrostatic latent image according to an aspect of some embodiments of the present disclosure, an external additive may be attached onto the surface of the toner base particles to improve the flowability, preservation stability, and cleanability of the toner.

Types of the external additive are not specifically limited within the scope of the present disclosure, and external additives traditionally used for a toner may be appropriately employed. Specific examples of preferred external additive include silica and metallic oxides such as alumina, titanium oxide, magnesium oxide, zinc oxide, strontium titanate, and barium titanate. These external additives may be used in combination.

The particle diameter of the external additive is not specifically limited without departing from the scope of the present disclosure and is preferably in the range from about 0.01 μm to about 1.0 μm.

The volume specific resistance value of the external additive can be adjusted by forming a coating layer on the surface of the external additive by using tin oxide and antimony oxide and then changing the thickness of the coating layer or the ratio of the tin oxide to the antimony oxide.

The amount of the external additive to be used for the toner base particles is not specifically limited within the scope of the present disclosure. In typical, the amount of the external additive to be used is preferably in the range from about 0.1 to about 10 parts by weight, more preferably in the range from about 0.2 to about 5 parts by weight with respect to 100 parts by weight of the toner base particles to which the external additive has not been attached. The external additive is used within these ranges, so that the toner having good flowability, preservation stability, and cleanability is easily produced.

An external additive to be used may be subjected to surface treatment by using a hydrophobizing agent. Use of the external additive subjected to the hydrophobic treatment can reduce the decrease in the charged amount of the toner under conditions of high temperature and high humidity and help the toner having good flowability to be produced. For instance, an aminosilane coupling agent can be used as the hydrophobizing agent. Specific examples of the aminosilane coupling agent include γ-aminopropyltriethoxysilane, γ-aminopropylmethoxysilane, N-(β-aminoethyl)-γ-aminopropyltrimethoxysilane, γ-(2-aminoethyl)-γ-aminopropylmethyldimethoxysilane, and γ-anilinopropyltrimethoxysilane. The aminosilane coupling agent may be used in combination with a hydrophobizing agent other than the aminosilane coupling agent to reinforce the hydrophobic effect. For example, hexamethyldisilazane effectively contributes to improvement of hydrophobic effect and the flowability of the toner and is therefore preferably used as the hydrophobizing agent other than the aminosilane coupling agent.

Silicone oil can be also used as the hydrophobizing agent for the external additive. Any type of silicone oil which provides an intended hydrophobic effect may be used, and various types of silicone oil which have been traditionally used as the hydrophobizing agent may be used. Silicone oil having a linear siloxane structure is preferably employed. Both of non-reactive silicone oil and reactive silicone oil can be used.

Specific examples of the silicone oil include dimethyl silicone oil, phenylmethyl silicone oil, chlorophenyl silicone oil, alkyl silicone oil, chloro silicone oil, polyoxyalkylene-modified silicone oil, fatty acid ester-modified silicone oil, methyl hydrogen silicone oil, silanol group-containing silicone oil, alkoxy group-containing silicone oil, acetoxy group-containing silicone oil, amino-modified silicone oil, carboxylic acid-modified silicone oil, and alcohol-modified silicone oil.

Examples of a technique for the hydrophobizing of the external additive include a technique in which the hydrophobizing agent such as aminosilane or silicone oil is added dropwise or sprayed while the external additive is stirred at high speed and a technique in which a solution of the hydrophobizing agent in an organic solvent is stirred and the external additive is added thereto. Heat treatment is conducted after the hydrophobic treatment, thereby yielding the hydrophobic external additive. In the case of adding dropwise or spraying the hydrophobizing agent, hydrophobizing agent may be neat or diluted by an organic solvent.

The toner for developing an electrostatic latent image according to an aspect of some embodiments of the present disclosure may be mixed with a predetermined carrier and used in the form of a two-component developer. In the case of preparing the two-component developer, a magnetic carrier is preferably used as the carrier.

A carrier in which a carrier core is coated with resin is preferably employed as the carrier to manufacture a two-component developer with the toner for developing an electrostatic latent image of the present disclosure. Specific examples of the carrier core include particles of iron, oxidized iron, reduced iron, magnetite, copper, silicon steel, ferrite, nickel, or cobalt; particles of alloys containing these materials and manganese, zinc, or aluminum; particles of an iron-nickel alloy or iron-cobalt alloy; particles of a ceramic such as titanium oxide, aluminum oxide, copper oxide, magnesium oxide, lead oxide, zirconium oxide, silicon carbide, magnesium titanate, barium titanate, lithium titanate, lead titanate, lead zirconate, or lithium niobate; particles of a high-dielectric material such as ammonium dihydrogen phosphate, potassium dihydrogen phosphate, or rochelle salt; and a resin carrier in which these magnetic particles are dispersed in resin.

Specific examples of the resin which coats the carrier core include (meth)acrylic polymers, styrene polymers, styrene-(meth)acrylic copolymers, olefin polymers (such as polyethylene, chlorinated polyethylene, and polypropylene), polyvinyl chloride, polyvinyl acetate, polycarbonate, cellulosic resin, polyester resin, unsaturated polyester resin, polyamide resin, polyurethane resin, epoxy resin, silicone resin, fluororesin (such as polytetrafluoroethylene, polychlorotrifluoroethylene, and polyvinylidene fluoride), phenol resin, xylene resin, diallyl phthalate resin, polyacetal resin, and amino resin. These resins may be used in combination.

The particle diameter of the carrier is not specifically limited within the scope of the present disclosure. The particle diameter of the carrier is measured with an electronic microscope and is preferably in the range from about 20 μm to about 120 μm, more preferably in the range from about 25 μm to about 80 μm.

The apparent density of the carrier is not specifically limited without departing from the scope of the present disclosure. The apparent density of the carrier differs depending on the composition and surface structure of the carrier and is preferably in the range from about 2.0 g/cm$^3$ to about 2.5 g/cm$^3$.

In the case of using the toner for developing an electrostatic latent image of the present disclosure as a two-component developer, the amount of the toner is preferably in the range from about 1 weight % to about 20 weight %, more preferably in the range from about 3 weight % to about 15 weight % with respect to the weight of the two-component developer. At the toner content of the two-component developer within these ranges, the appropriate image density of a formed image can be maintained, and the scattering of the toner can be reduced with the result that contamination inside an image-forming apparatus and adherence of the toner onto transfer paper can be reduced.

The toner for developing an electrostatic latent image according to an aspect of some embodiments of the present disclosure can be produced through the following processes: mixing the binder resin with other components such as a colorant, a releasing agent, a charge-controlling agent, and magnetic powder; preparing toner base particles having a predetermined diameter; and attaching the external additive onto the surface of the prepared toner base particles.

A method for producing the toner which involves mixing the binder resin with other components such as the colorant, the releasing agent, the charge-controlling agent, and the magnetic powder is not specifically limited as long as, in the resulting toner, the average aspect ratio of the toner particles having diameters of at least about 3 μm and less than about 10 μm is in the rang from about 0.820 to about 0.900 and the difference between a maximum value and a minimum value among the average aspect ratios D3, D4, D5, D6, D7, D8, and D9 is up to about 0.07, Dn representing an average aspect ratio of those toner particles having diameters of at least about n μm and less than about n+1 μm.

A preferred method for preparing the toner particles having the above diameter and aspect ratio includes the following processes: mixing the binder resin with the other components such as the colorant, the releasing agent, the charge-controlling agent, and the magnetic powder with a mixer; melt-kneading the binder resin and the other components to be mixed using a kneader, such as a single or twin screw extruder, to yield a kneaded product; and pulverizing the kneaded product into fine powder through several steps, preferably, at least three steps, with a mechanical pulverizer in a technique in which the kneaded product is cooled and then is roughly pulverized, finely pulverized and classified, the pulverizing being performed such that a volume average diameter (D50) is gradually decreased through each pulverizing step.

In the case of performing the fine pulverizing in a single step with a mechanical pulverizer for an intended particle diameter, a particle diameter is changed in the initial stage of the fine pulverizing mainly for the reason that the toner base particles are chamfered, and the particle diameter is changed in the late stage of the fine pulverizing mainly for the reason that the toner base particles are broken because removal of the corners of the toner base particles has been done. Toner base particles having a small aspect ratio are therefore produced. On the other hand, in the multistep fine pulverizing with a mechanical pulverizer, decrease in the aspect ratio by the breaking of the toner base particles can be reduced, and the particle diameter can be more likely to be changed as a result of chamfering the particles. Toner base particles having a relatively large aspect ratio are therefore produced.

The average aspect ratio of the toner particles and the distribution of the aspect ratio can be measured by the following method.

A flow-type particle image analyzer [FPIA-3000 (manufactured by SYSMEX CORPORATION)] is used to measure the average aspect ratio of the toner particles and the distribution of the average aspect ratio. The minor and major axes of the toner particles having an equivalent circle diameter of at least 0.60 μm and less than 400 μm are measured under conditions of 23° C. and 60% relative humidity (RH), and the aspect ratios of the individual toner particles are determined from the following formula. From the determined aspect ratios of the individual toner particles, the sum total of the aspect ratios of the measured toner particles having an equivalent circle diameter of at least 3 μm and less than 10 μm is determined. The value of the sum total is divided by the numbers of measured toner particles having an equivalent circle diameter of at least 3 μm and less than 10 μm, thereby determining the average aspect ratio of the toner particles having an equivalent circle diameter of at least 3 μm and less than 10 μm. An average aspect ratio, Dn, represents the average aspect ratio of the toner particles having a diameter of at least n μm and less than n+1 μm. According to an aspect of some embodiments of the present disclosure, n is an integer from 3 to 9, which means that D3 to D9 are determined. In particular, in the determination of the D3 value, for example, the sum total of the aspect ratios of the measured toner particles having an equivalent circle diameter of at least 3 μm and less than 4 μm is determined. The value of the sum total is divided by the numbers of measured toner particles having an equivalent circle diameter of at least 3 μm and less than 4 μm, thereby determining the D3 value. Since a small variation between the values of D3 to D9 gives good results, the standard deviation Dσ of the aspect ratio Dn of the toner is preferably in a range from about 0.0190 to about 0.0233.

Aspect Ratio-Calculating Formula $$\text{Aspect Ratio}=\text{Minor Axis}/\text{Major Axis}$$

In the toner of the present disclosure, the toner particles having a diameter of at least about 3 μm and less than about 10 μm have average circularity that is preferably in the range from about 0.965 to about 0.980, more preferably in the range from about 0.968 to about 0.980. In the case where the average circularity is excessively small, the toner particles may not have a perfectly spherical shape. The coefficient of contact friction between the toner and a latent image bearing member (photoconductive drum) is therefore increased, and the toner is less likely to be moved from the surface of the latent image bearing member when a toner image is transferred from the latent image bearing member to a recording medium. In this case, formation of a defective image may be caused, such as the occurrence of a dropout. In the case where the average circularity is excessively large, the toner particles may pass through a device for removing a residual toner, which is adhering to the latent image bearing member, when the residual toner is cleaned. Although a technique to adjust the circularity of the toner is not specifically limited, the circularity can be adjusted, for example, as a result of appropriately changing the number of times of fine pulverizing with a mechanical pulverizer in the preparation of the toner in the same manner as in adjustment of the aspect ratio. The toner base particles are heated before the external additive is added, thereby being able to enhance the average circularity of the toner.

The average circularity of the toner particles having a diameter of at least 3 μm and less than 10 μm can be measured by the following method.

A flow-type particle image analyzer [FPIA-3000 (manufactured by SYSMEX CORPORATION)] is used to measure the average circularity of the toner particles. The circumferential lengths (L0) of circles having the same projected areas as that of toner particle images and the circumferential lengths (L) of projected images of the toner particle having an equivalent circle diameter of at least 0.60 μm and less than 400 μm are measured under the conditions of 23° C. and 60% RH, and circularity is determined by the following formula. The sum total of the circularity of the measured toner particles having an equivalent circle diameter of at least 3 μm and less than 10 μm is divided by the numbers of measured toner particles having an equivalent circle diameter of at least 3 μm and less than 10 μm, and the obtained value is determined as the average circularity.

Circularity-Calculating Formula $$\text{Circularity}=L0/L$$

In the toner of the present disclosure, the percentage of the fine powder having a particle diameter of 4.0 μm or smaller is preferably about 8% or lower, more preferably about 7.5% or lower. In the case where the percentage of the fine powder is excessively large, the fine powder makes a broad electrostatic charge distribution. As a result, the image density may fall below an intended level in long-term printing. The percentage of the fine powder can be adjusted as a result of appropriately changing the conditions of the classification in the preparation of the toner.

In the toner according to an aspect of some embodiments of the present disclosure, the standard deviation (SD) of the volume distribution of the particle diameter is preferably about 1.25 or smaller, and more preferably about 1.24 or smaller. In the case where the standard deviation of the volume distribution of the particle diameter is excessively large, electrostatic charge distribution becomes broad. As a result, the image density may fall below an intended level in long-term printing. As in the case of adjustment of the percentage of the fine powder, the SD of the volume distribution of the particle diameter can be adjusted as a result of appropriately changing the conditions of the classification in the preparation of the toner.

The external additive may be optionally attached onto the surface of the toner base particles formed in the manner described above. A technique to attach the external additive onto the surface of the toner base particles is not specifically limited, and a technique is employed, for instance, in which the toner base particles are mixed with the external additive with a mixer such as Henschel mixer or Nauta mixer under mixing conditions which prevent the external additives from being embedded in the toner particles.

The volume average particle diameter of the toner can be measured by the following method.

A Coulter counter Multisizer 3 (manufactured by Beckman Coulter, Inc.) can be used to measure the volume average particle diameter of the toner. An ISOTON II (manufactured by Beckman Coulter, Inc.) is used as an electrolytic solution, and an aperture having a diameter of 100 μm is used. A small amount of a surfactant is added to the electrolytic solution (ISOTON II), and 10 mg of the toner is added to the resulting solution. An ultrasonic disperser is used to disperse the toner in the electrolytic solution. The electrolytic solution in which the toner is dispersed is used as a measurement sample, and the particle size distribution of the toner is measured with the Coulter counter Multisizer 3, thereby obtaining the volume average particle diameter of the toner. Since high quality such as good reproducibility of thin lines can be imparted to images to be formed and contamination of a developing sleeve by the ultrafine powder content can be reduced, the volume average particle diameter of the toner is preferably in the range from about 5 μm to about 10 μm.

The toner for developing an electrostatic latent image according to an aspect of some embodiments of the present disclosure can be used in various types of image-forming apparatuses which form images by employing one or two component development method. In the two component development method, a touchdown development method has advantages in image quality and lifetime and is described with reference to FIG. 1.

In the case where the touchdown development method is used, defective charging of the two component developer readily causes problems such as the occurrence of fogging in a formed image and scattering of the toner inside the image-forming apparatus. However, since the toner of the present disclosure has advantages as described above, the use of a two component developer containing the toner of the present disclosure overcomes the problems caused in the touchdown development method.

The touchdown development method includes the following processes. A magnetic blush of the two component developer is formed on the surface of a magnetic roller. Only the toner is then transported from the magnetic brush to the surface of a developing roller which is disposed so as to face a photoconductor, thereby forming a toner layer on the surface of the developing roller. The toner is subsequently transported from the toner layer to the photoconductor, and an electrostatic latent image formed on the surface of the photoconductor is developed as a toner image.

FIG. 1 illustrates an image-forming apparatus 10 using the touchdown development method, and the image-forming apparatus 10 includes a drum-shaped photoconductor 11, a charging portion 12, an exposing portion 13, a developing portion 14, a transferring portion 16, and a cleaning portion 17. The charging portion 12 charges the surface of the photoconductor 11. The exposing portion 13 exposes the surface of the photoconductor 11, so that an electrostatic latent image is formed on the surface of the photoconductor 11. The developing portion 14 develops the electrostatic latent image by using the toner, thereby forming a toner image. The transferring portion 16 transfers the toner image from the photoconductor 11 to a recording medium transported on an endless belt 15. The cleaning portion 17 cleans the surface of the photoconductor 11.

The photoconductor 11 may be provided in the form of an inorganic photoconductor, which is formed by using selenium or amorphous silicon, or an organic photoconductor in which a single- or multi-layered photoconductive layer containing a charge-generating agent, charge-transporting agent, and binder resin is formed on a conductive base. The charging portion 12 may be provided in the form of a scorotron charger, charging roller, or charging brush. Known structures can be employed for the exposing portion 13, transferring portion 16, and cleaning portion 17.

The developing portion 14 includes a magnetic roller 18 (developer bearing member), a developing roller 19 (toner bearing member), power sources 20, 22, and 24, a regulating blade 26, a container 28, an agitation mixer 30, a paddle mixer 34, a partition 32, and a frame 36. A magnetic brush (not illustrated) of the two component developer is formed on the surface of the magnetic roller 18. The toner is transported from the magnetic brush formed on the magnetic roller 18 to form a toner layer (not illustrated) on the surface of the developing roller 19. The power source 20 applies a direct current (DC) bias to the magnetic roller 18. The power source 22 applies a DC bias to the developing roller 19. The power source 24 applies an alternate current (AC) bias to the developing roller 19. The regulating blade 26 keeps the height of the magnetic brush formed on the magnetic roller 18 in a certain level. The toner is accommodated in the container 28. The agitation mixer 30 charges the toner of the two component developer. The paddle mixer 34 transports the two component developer, which has been supplied from the agitation mixer 30, to the magnetic roller 18 while agitating the two component developer. The partition 32 divides the space between the agitation mixer 30 and the paddle mixer 34. The developer is transported from the agitation mixer 30 to the paddle mixer 34 through channels (not illustrated) provided between the partition 32 and the frame 36 described below. The frame 36 accommodates the magnetic roller 18, developing roller 19, agitation mixer 30, and paddle mixer 34. A plurality of stationary magnets (not illustrated) are arranged inside the magnetic roller 18, and the sleeve (not illustrated) of the magnetic roller 18 can rotate around the stationary magnets. The developing roller 19 is disposed so as to face the photoconductor 11.

With the image-forming apparatus 10, illustrated in FIG. 1, using touchdown development, images are formed by a method including a charging process, exposing process, and developing process. In the charging process, the surface of the photoconductor 11 is charged by the charging portion 12. In the exposing process, the exposing portion 13 exposes the surface of the photoconductor 11, thereby forming an electrostatic latent image on the surface of the photoconductor 11. In the developing process, the two component developer containing the toner and carrier forms the magnetic brush on the surface of the magnetic roller 18, only the toner is separated from the magnetic brush to form the toner layer on the surface of the developing roller 19, and the toner in the toner layer is attached to the electrostatic latent image formed on the surface of the photoconductor 11 by the exposure, thereby forming a toner image.

Images are specifically formed as follows. The surface of the photoconductor 11 is charged by the charging portion 12. The surface of the photoconductor 11 is then exposed by the exposing portion 13 to form an electrostatic latent image. The toner contained in the two component developer is charged by the agitation mixer 30 in the developing portion 14. The two component developer is supplied to the magnetic roller 18 by the paddle mixer 34, and the two component developer is held on the surface of the magnetic roller 18, thereby forming the magnetic brush. Only the toner is then transported from the magnetic brush to the surface of the developing roller 19 to form the toner layer on the surface of the developing roller 19.

The toner is subsequently transported from the toner layer on the developing roller 19 to the photoconductor 11, and the toner is attached to exposed portions of the electrostatic latent image formed on the surface of the photoconductor 11, thereby developing the electrostatic latent image as a toner image. The toner image is transferred by the transferring portion 16 from the photoconductor 11 to a recording medium transported on the endless belt 15, thereby forming an image on the recording medium. The surface of the photoconductor 11 is cleaned by the cleaning portion 17 after the transfer. The above processes are repeated.

The toner supplied from the container 28 is mixed with a carrier by the agitation mixer 30, thereby being formed into the two component developer.

The touchdown development method enables color images to be formed at high speed and is therefore often employed in tandem-type color image-forming apparatuses using toners of a plurality of colors. In the case of employing the touchdown development method in the tandem-type color image-forming apparatus, the developing roller 19 is generally disposed below the magnetic roller 18 in order to reduce the size of the developing portion 14. In this case, the developer is readily subjected to stress, and toner is likely to be excessively charged because of an effect of embedding of the external additive into the toner base particles in long-term printing at low print ratio. The excessive charging of the toner frequently causes the toner and the components contained in the toner to adhere to the developing roller 19.

In particular, between the magnetic roller 18 and the developing roller 19, the toner charged at a predetermined charged amount is transported from the magnetic roller 18 to the developing roller 19, while the toner which has not transported from the developing roller 19 to the photoconductor 11 and left on the developing roller 19 is recovered to the magnetic roller 18. The toner is therefore freshly transported to the developing roller 19 at any time.

In the configuration in which the developing roller 19 is disposed below the magnetic roller 18, however, the toner needs to be transported from the developing roller 19 to the magnetic roller 18 against gravitational force, and it is therefore difficult to recover the toner. In the case where the toner is excessively charged, image force of the toner to the developing roller is increased with the result that the toner is likely to adhere to the developing roller 19, and it may therefore become difficult to recover the toner from the developing roller 19 to the magnetic roller 18. As a result, the residual toner constantly remains on the developing roller 19 without being recovered, and the excessive charging of the toner is consequently further enhanced. The adhesion of the toner to the developing roller 19 is accordingly increased, and the excessive electrification charge of the toner adhering to the developing roller 19 therefore may prevent the toner, which should be transported from the magnetic roller 18 to the developing roller 19, from forming the toner layer on the developing roller 19. Thus, difficulty may arise in formation of a high-quality image.

However, use of the toner for developing an electrostatic latent image according to an aspect of some embodiments of the present disclosure provides the following advantages: occurrence of a dropout is reduced in the transfer of a toner image from the latent image bearing member; and formation of a defective image caused by failure in the cleaning of the residual toner is reduced. Even in the image-forming apparatus using the touchdown development method which is likely to cause the toner and components contained in the toner to adhere to the developing sleeve as described above, the toner of the present disclosure reduces the adhesion of the toner to the developing sleeve and enhances high-quality images to be formed.

Toners according to some aspects of the present disclosure will be hereinafter described further in detail with reference to examples. The present disclosure should not be limited to these examples.

Polyester resin used as a binder resin both in these examples and comparative examples was prepared as described in Preparation Example 1.

A propylene oxide adduct of bisphenol A (1960 g), ethylene oxide adduct of bisphenol A (780 g), dodecenyl succinic anhydride (257 g), terephthalic acid (770 g), and dibutyltin oxide (4 g) were fed in a reaction container. The inside of the reaction container was then under a nitrogen atmosphere, and temperature inside the reaction container was increased to about 235° C. while the fed materials were stirred. The reaction was promoted at the same temperature for eight hours. Pressure inside the reaction container was then reduced to 8.3 kPa, and reaction was promoted for an hour. The reaction mixture was cooled to 180° C., and trimellitic anhydride was fed into the reaction container so that the reaction mixture has predetermined acid number. The temperature of the reaction mixture was increased to 210° C. at a rate of 10° C./hour to promote the reaction at this temperature. After the reaction, the content in the reaction container was recovered and then cooled, thereby yielding a polyester resin.

Example 1

The polyester resin prepared in Preparation Example 1 (100 parts by weight), carnauba wax [carnauba wax type 1 (manufactured by S. Kato & Co.), 5 parts by weight], charge-controlling agent [P-51 (manufactured by ORIENT CHEMICAL INDUSTRIES CO., LTD.), 2 parts by weight], and carbon black [MA 100 (manufactured by Mitsubishi Chemical Corporation), 5 parts by weight] were mixed by using a mixer, thereby yielding a mixture. The mixture was then melt-kneaded by using a twin screw kneader, thereby producing a kneaded product. The kneaded product was roughly pulverized with a pulverizer [ROTOPLEX (manufactured by TOAKIKAI KOGYO CO., LTD)] to produce a coarsely pulverized product having a volume average particle diameter (D50) of about 20 μm. A mechanical pulverizer [turbo mill (manufactured by FREUND-TURBO CORPORATION)] was then used to finely pulverize the coarsely ground product in 12 steps, thereby yielding a finely pulverized product. A classifier [Elbow-Jet (manufactured by Nittetsu Mining Co., Ltd.)] was used to classify the finely pulverized product, thereby yielding toner base particles having a volume average particle diameter (D50) of 6.7 μm. The volume average particle diameters (D50) of the toner base particles after the individual pulverizing steps are listed in Table 1.

To the toner base particles, hydrophobic silica [REA200 (manufactured by Nippon Aerosil Co., Ltd.)] and titanium oxide [EC-100 (manufactured by Titan Kogyo, Ltd.)] were added respectively in amounts of 1.8 weight % and 1.0 weight % with respect to the weight of the toner base particles. The resultant product was stirred and mixed by using a Henschel mixer (manufactured by Mitsui Mining Co., Ltd.) at a rotation speed of 30 m/second for 5 minutes, thereby yielding a black toner having a volume average particle diameter of 6.8 μm. The volume average particle diameter, average circularity, and average aspect ratio of the resultant black toner were measured by the following methods. The volume average particle diameter, average circularity, and average aspect ratio of the black toner of Example 1 are listed in Table 2.

A Coulter counter Multisizer 3 (manufactured by Beckman Coulter, Inc.) was used to measure the volume average particle diameter of the toner of Example 1. An ISOTON II (manufactured by Beckman Coulter, Inc.) was used as an electrolytic solution, and an aperture having a diameter of 100 μm was used. A small amount of a surfactant was added to the electrolytic solution (ISOTON II), and 10 mg of the toner of Example 1 was added to the resulting solution. An ultrasonic disperser was used to disperse the toner of Example 1 in the electrolytic solution. The electrolytic solution in which the toner of Example 1 was dispersed was used as a measurement sample, and the particle size distribution of the toner of Example 1 was measured with the Coulter counter Multisizer 3, thereby determining the volume average particle diameter of the toner of Example 1.

A flow-type particle image analyzer [FPIA-3000 (manufactured by SYSMEX CORPORATION)] was used to measure the average circularity of the toner of Example 1. The circumferential lengths (L0) of circles having the same projected areas as that of toner particle images and the circumferential lengths (L) of projected images of the toner particle of Example 1 having an equivalent circle diameter of at least 0.60 μm and less than 400 μm were measured under the conditions of 23° C. and 60% RH, and circularity was determined by the following formula. The sum total of the circularity of the measured toner particles of Example 1 having an equivalent circle diameter of at least 3 μm and less than 10 μm was divided by the numbers of measured toner particles of Example 1 having an equivalent circle diameter of at least 3

μm and less than 10 μm, and the obtained value was determined as the average circularity.

Circularity-Calculating Formula

Circularity $a=L0/L$

A flow-type particle image analyzer [FPIA-3000 (manufactured by SYSMEX CORPORATION)] was used to measure the average aspect ratio and the distribution of the average aspect ratio of the toner of Example 1. The minor and major axes of the toner particles of Example 1 having an equivalent circle diameter of at least 0.60 μm and less than 400 μm were measured under conditions of 23° C. and 60% RH, and the aspect ratios of individual toner particles of Example 1 were determined by the following formula. From the determined aspect ratios of the individual toner particles of Example 1, the sum total of the aspect ratios of the measured toner particles of Example 1 having an equivalent circle diameter of at least 3 μm and less than 10 μm was determined. The value of the sum total was divided by the numbers of measured toner particles of Example 1 having an equivalent circle diameter of at least 3 μm and less than 10 μm, thereby determining the average aspect ratio of the toner particles of Example 1 having an equivalent circle diameter of at least 3 μm and less than 10 μm. An average aspect ratio, Dn, represents the average aspect ratio of the toner particles having a diameter of at least n μm and less than n+1 μm. According to an aspect of some embodiments of the present disclosure, n is an integer from 3 to 9, which means that D3 to D9 were determined. In particular, in the determination of the D3 value, for example, the sum total of the aspect ratios of the measured toner particles of Example 1 having an equivalent circle diameter of at least 3 μm and less than 4 μm was determined. The value of the sum total was divided by the numbers of measured toner particles of Example 1 having an equivalent circle diameter of at least 3 μm and less than 4 μm, thereby determining the D3 value. From the values of D3 to D9, standard deviation Dσ of the values of D3 to D9 was calculated.

Aspect Ratio-Calculating Formula

Aspect Ratio $b$=Minor Axis/Major Axis

The black toner of Example 1 was subjected to the evaluation of image quality, transferability, and cleanability by the following methods. The evaluation results of the black toner of Example 1 are listed in Table 2.

A carrier (100 parts by weight) for a developer used in a printer [FS-05016 (manufactured by KYOCERA MITA Corporation)] was mixed with the toner of Example 1 (10 parts by weight) to produce a two component developer. The printer [FS-05016 (manufactured by KYOCERA MITA Corporation)] was used for the evaluation of the image quality. The two component developer of Example 1 was put into a developing unit of the printer, and the toner of Example 1 was put into a toner container of the printer. Images were continuously printed on 5000 pieces of paper at 23° C. and 60% RH under the following conditions: a printing rate of 16 pieces/minute; and 5% printing ratio. Image evaluation patterns were then output. Solid images and half-tone images (printing ratio 50%) in the image evaluation patterns and the state of a sleeve of a developing roller were visually observed, and the image quality was evaluated on the basis of the following criteria. The results 5 and 4 are practically acceptable.

5: Adhesive substances were not observed on the developing sleeve, and the solid images and the half-tone images had good quality;

4: A small amount of adhesive substances were observed on the developing sleeve, and the solid images and the half-tone images had good quality;

3: Adhesive substances were significantly observed on the developing sleeve, and periodic defects of image formation (unevenness of a sleeve layer) were slightly observed in the solid images and the half-tone images;

2: Adhesive substances were significantly observed on the developing sleeve, periodic defects of image formation (unevenness of a sleeve layer) were significantly observed in the solid images and the half-tone images, and formations of defective images were caused by the adhesive substances on the developing sleeve in the middle of durable printing of 5000 pieces of paper; and 1: Adhesive substances were significantly observed on the developing sleeve, periodic defects of image formation (unevenness of a sleeve layer) were significantly observed in the solid images and the half-tone images, and formations of defective images caused by the adhesive substances on the developing sleeve were observed in the early stage of the image formation.

The printer [FS-05016 (manufactured by KYOCERA MITA Corporation)] was used for the evaluation of transferability. The two component developer of Example 1 was put into the developing unit, and a thin-line image was formed as an initial image. The thin-line image was observed with a loupe to find dropouts, and transferability was evaluated on the basis of the following criteria. The results 5 and 4 are practically acceptable.

5: Dropouts were not found;

4: A slight amount of dropouts were found;

3: A small amount of dropouts were found;

2: A large amount of dropouts were locally found; and

1: Dropouts were significantly found in a wide range.

The printer [FS-05016 (manufactured by KYOCERA MITA Corporation)] was used for the evaluation of cleanability. Subsequent to the evaluation of the transferability, a blank image was formed immediately after the formation of a solid image. The blank image was visually observed to evaluate the state of pass-through of the toner. The result 3 is practically acceptable.

3: Black lines caused by the passing-through of the toner were not observed in the blank image;

2: Black lines caused by the passing-through of the toner were slightly observed in the blank image; and 1: Black lines caused by the passing-through of the toner were significantly observed in the blank image.

Examples 2 TO 5 and Comparative Examples 1 to 3

Except that the pulverizing was performed so as to provide the volume average particle diameters (D50) listed in Table 1 after the individual pulverizing steps, toners of Examples 2 to 5 and Comparative Examples 1 to 3 were produced by fine pulverizing in the number of times listed in Table 1 in the same manner as employed in Example 1. The image quality, transferability, and cleanability of the toners of Examples 2 to 5 and Comparative Examples 1 to 3 were evaluated in the same manner as in the toner of Example 1. Along with the volume average particle diameter, average circularity, and average aspect ratio, the evaluation results of the toners of Examples 2 to 5 are listed in Table 2, and the evaluation results of the toners of Comparative Examples 1 to 3 are listed in Table 3.

Comparative Example 4

An impact type pulverizer [jet mill (manufactured by Hosokawa Micron Corporation)] was used in the finely pulverizing process, and the finely pulverizing process had a single step. Except for these changes, a toner of Comparative Example 4 was produced in the same manner as in Example 1. The image quality, transferability, and cleanablity of the toner of Comparative Example 4 were evaluated in the same manner as in the toner of Example 1. The evaluation results of the toner of Comparative Example 4 are listed in Table 3 along with the volume average particle diameter, average circularity, and average aspect ratio.

Comparative Example 5

The toner base particles produced in Comparative Example 4 before the attachment of the external additive were treated with a spheronization process at 300° C. using a suffusion system (manufactured by Nippon Pneumatic Mfg. Co., Ltd.). The external additive was attached to the spheronization processed toner base particles in the same manner as in Example 1, thereby yielding a toner of Comparative Example 5. The image quality, transferability, and cleanablity of the toner of Comparative Example 5 were evaluated in the same manner as in the toner of Example 1. The evaluation results of the toner of Comparative Example 5 are listed in Table 3 along with the volume average particle diameter, average circularity, and average aspect ratio.

Comparative Example 6

The toner base particles produced in Comparative Example 4 before the attachment of the external additive were treated with a spheronization process at 350° C. using the suffusion system (manufactured by Nippon Pneumatic Mfg. Co., Ltd.). The external additive was attached to the spheronization processed toner base particles in the same manner as in Example 1, thereby yielding a toner of Comparative Example 6. The image quality, transferability, and cleanablity of the toner of Comparative Example 6 were evaluated in the same manner as in the toner of Example 1. The evaluation results of the toner of Comparative Example 6 are listed in Table 3 along with the volume average particle diameter, average circularity, and average aspect ratio.

TABLE 1

| Particle diameter after pulverizing (D50)(μm) | Number of times of pulverizing (times) | Number of times of pulverizing 1 | 2 | 3 | 4 | 5 | 6 | 7 | 8 | 9 | 10 | 11 | 12 |
|---|---|---|---|---|---|---|---|---|---|---|---|---|---|
| Example 1 | 12 | 12.0 | 9.9 | 8.8 | 8.1 | 7.9 | 7.6 | 7.2 | 7.1 | 6.9 | 6.7 | 6.5 | 6.5 |
| Example 2 | 10 | 11.5 | 9.4 | 8.4 | 7.7 | 7.4 | 7.2 | 6.9 | 6.7 | 6.7 | 6.6 | — | — |
| Example 3 | 8 | 10.0 | 9.1 | 8.3 | 7.5 | 7.2 | 7.0 | 6.8 | 6.6 | — | — | — | — |
| Example 4 | 6 | 9.7 | 9.0 | 7.9 | 7.2 | 6.9 | 6.5 | — | — | — | — | — | — |
| Example 5 | 4 | 9.0 | 8.0 | 7.1 | 6.5 | — | — | — | — | — | — | — | — |
| Comparative example 1 | 2 | 8.1 | 6.5 | — | — | — | — | — | — | — | — | — | — |
| Comparative Example 2 | 1 | 6.6 | — | — | — | — | — | — | — | — | — | — | — |
| Comparative Example 3 | 2 | 8.0 | 6.6 | — | — | — | — | — | — | — | — | — | — |
| Comparative Example 4 | 1 | 6.5 | — | — | — | — | — | — | — | — | — | — | — |
| Comparative Example 5 | 1 | 6.5 | — | — | — | — | — | — | — | — | — | — | — |
| Comparative Example 6 | 1 | 6.5 | — | — | — | — | — | — | — | — | — | — | — |

TABLE 2

| | Examples 1 | 2 | 3 | 4 | 5 |
|---|---|---|---|---|---|
| Volume average particle diameter (μm) | 6.7 | 6.8 | 6.8 | 6.7 | 6.7 |

TABLE 2-continued

| | Examples 1 | 2 | 3 | 4 | 5 |
|---|---|---|---|---|---|
| Average circularity | 0.972 | 0.969 | 0.967 | 0.965 | 0.960 |
| Average aspect ratio | 0.873 | 0.830 | 0.826 | 0.823 | 0.820 |
| D3(3~4 μm) | 0.884 | 0.850 | 0.840 | 0.839 | 0.836 |
| D4(4~5 μm) | 0.831 | 0.790 | 0.785 | 0.783 | 0.781 |
| D5(5~6 μm) | 0.871 | 0.811 | 0.809 | 0.803 | 0.801 |
| D6(6~7 μm) | 0.879 | 0.827 | 0.821 | 0.819 | 0.813 |
| D7(7~8 μm) | 0.881 | 0.841 | 0.839 | 0.832 | 0.831 |
| D8(8~9 μm) | 0.883 | 0.843 | 0.840 | 0.838 | 0.833 |
| D9(9~10 μm) | 0.882 | 0.850 | 0.850 | 0.849 | 0.847 |
| Dσ | 0.0190 | 0.0226 | 0.0228 | 0.0233 | 0.0231 |
| Dmax | 0.884 | 0.850 | 0.850 | 0.849 | 0.847 |
| Dmin | 0.831 | 0.790 | 0.785 | 0.783 | 0.781 |
| Dmax − Dmin | 0.053 | 0.060 | 0.065 | 0.066 | 0.066 |
| Image quality | 5 | 5 | 5 | 5 | 5 |
| Transferability | 5 | 5 | 5 | 5 | 4 |
| Cleanability | 3 | 3 | 3 | 3 | 3 |

TABLE 3

| | Comparative example 1 | 2 | 3 | 4 | 5 | 6 |
|---|---|---|---|---|---|---|
| Volume average particle diameter (μm) | 6.7 | 6.8 | 6.8 | 6.7 | 6.7 | 6.7 |
| Average circularity | 0.951 | 0.947 | 0.952 | 0.959 | 0.980 | 0.990 |
| Average aspect ratio | 0.801 | 0.772 | 0.818 | 0.875 | 0.936 | 0.937 |
| D3(3~4 μm) | 0.780 | 0.719 | 0.830 | 0.931 | 0.930 | 0.933 |

TABLE 3-continued

| | Comparative example 1 | 2 | 3 | 4 | 5 | 6 |
|---|---|---|---|---|---|---|
| D4(4~5 μm) | 0.751 | 0.749 | 0.782 | 0.932 | 0.934 | 0.938 |
| D5(5~6 μm) | 0.790 | 0.764 | 0.801 | 0.935 | 0.941 | 0.943 |

TABLE 3-continued

| | Comparative example | | | | | |
|---|---|---|---|---|---|---|
| | 1 | 2 | 3 | 4 | 5 | 6 |
| D6(6~7 μm) | 0.803 | 0.777 | 0.814 | 0.832 | 0.944 | 0.946 |
| D7(7~8 μm) | 0.818 | 0.790 | 0.825 | 0.831 | 0.944 | 0.944 |
| D8(8~9 μm) | 0.832 | 0.813 | 0.834 | 0.830 | 0.936 | 0.936 |
| D9(9~10 μm) | 0.833 | 0.793 | 0.843 | 0.835 | 0.920 | 0.920 |
| Dσ | 0.0298 | 0.0313 | 0.0211 | 0.0538 | 0.0086 | 0.0089 |
| Dmax | 0.833 | 0.813 | 0.843 | 0.935 | 0.944 | 0.946 |
| Dmin | 0.751 | 0.719 | 0.782 | 0.830 | 0.920 | 0.920 |
| Dmax − Dmin | 0.082 | 0.094 | 0.061 | 0.105 | 0.024 | 0.026 |
| Image quality | 4 | 4 | 5 | 5 | 4 | 3 |
| Transferability | 3 | 3 | 3 | 3 | 5 | 5 |
| Cleanability | 3 | 3 | 3 | 3 | 2 | 1 |

Tables 1 and 2 demonstrate the following: since the production of the toner involved the finely pulverizing process including the several steps with a mechanical pulverizer (turbo mill), the toner was able to be prepared, which had an average aspect ratio ranging from about 0.820 to about 0.900 and in which the difference between the maximum value Dmax and minimum value Dmin f the average aspect ratio Dn (n is an integer from 3 to 9) of the toner particles having a diameter of at least n μm and less than n+1 μm was up to 0.07.

In the case of performing the fine pulverizing in a single step for an intended particle diameter, a particle diameter is changed at first in the fine pulverizing mainly for the reason that the toner particles are chamfered, and the particle diameter is further changed in the fine pulverizing mainly for the reason that the toner particles are broken because removal of the corners of the toner particles has been done. Thus, toner particles having a small aspect ratio are produced. In the multistep fine pulverizing of the toner particles, the particle diameter can be more likely to be changed as a result of chamfering the particles, thereby being able to produce toner particles having a relatively large aspect ratio.

Table 2 demonstrates the following: in the toners of Examples 1 to 5, an average aspect ratio was in the range from about 0.820 to about 0.900, the difference between the maximum value Dmax and minimum value Dmin of the average aspect ratio Dn (n is an integer from 3 to 9) of the toner particles having a diameter of at least n μm and less than n+1 μm was up to 0.07, and good image quality, transferability, and cleanability were exhibited.

Table 3 demonstrates that the toners of Comparative Examples 1 and 2 having an average aspect ratio less than 0.820 and exhibiting Dmax−Dmin exceeding 0.07 provided slightly poor image quality and significantly unsatisfactory transferability. Furthermore, the toner of Comparative Example 3 exhibiting Dmax−Dmin of 0.07 or lower but having an average aspect ratio less than 0.820 provided satisfactory image quality and significantly unsatisfactory transferability. Moreover, the toner of Comparative Example 4 having an average aspect ratio falling within the range of 0.820 to 0.900 but exhibiting Dmax−Dmin exceeding 0.07 provided satisfactory image quality and significantly unsatisfactory transferability.

Table 3 demonstrates that the toners of Comparative Examples 5 and 6 exhibiting Dmax−Dmin of 0.07 or lower but having an average aspect ratio exceeding 0.900 provided satisfactory transferability, slightly poor image quality, and significantly unsatisfactory cleanability.

Having thus described in detail embodiments of the present disclosure, it is to be understood that the subject matter disclosed by the foregoing paragraphs is not to be limited to particular details and/or embodiments set forth in the above description. For example, particular numerical values or ranges are provided by way of illustration for clarity of exposition, and are not intended to limit the possible values or ranges that may be implemented in accordance with the present disclosure. Additionally, the present disclosure may be practiced without necessarily providing one or more of the advantages described herein or otherwise understood in view of the disclosure and/or that may be realized in some embodiments thereof. Accordingly, it is understood that many variations of the embodiments and subject matter disclosed herein are possible without departing from the scope of the present disclosure.

What is claimed is:

1. A toner for developing an electrostatic latent image comprising toner particles having diameters of at least 3 μm and less than 4 μm, toner particles having diameters of at least 4 μm and less than 5 μm, toner particles having diameters of at least 5 μm and less than 6 μm, toner particles having diameters of at least 6 μm and less than 7 μm, toner particles having diameters of at least 7 μm and less than 8 μm, toner particles having diameters of at least 8 μm and less than 9 μm, and toner particles having diameters of at least 9 μm and less than 10 μm, wherein the toner particles have faces provided by chamfering, wherein an average aspect ratio of the toner particles having predetermined diameters of at least 3 μm and less than 10 μm is in a range from about 0.820 to about 0.900, and wherein the difference between a maximum value and a minimum value among the average aspect ratios D3 (D3 represents an average aspect ratio of the toner particles having diameters of at least 3 μm and less than 4 μm), D4 (D4 represents an average aspect ratio of the toner particles having diameters of at least 4 μm and less than 5 μm), D5 (D5 represents an average aspect ratio of the toner particles having diameters of at least 5 μm and less than 6 μm), D6 (D6 represents an average aspect ratio of the toner particles having diameters of at least 6 μm and less than 7 μm), D7 (D7 represents an average aspect ratio of the toner particles having diameters of at least 7 μm and less than 8 μm), D8 (D8 represents an average aspect ratio of the toner particles having diameters of at least 8 μm and less than 9 μm), and D9 (D9 represents an average aspect ratio of the toner particles having diameters of at least 9 μm and less than 10 μm) is up to about 0.07.

2. The toner for developing an electrostatic latent image according to claim 1, wherein an average circularity of the toner particles having the diameters of at least 3 μm and less than 10 μm is in a range from about 0.965 to about 0.980.

3. The toner for developing an electrostatic latent image according to claim 2, wherein the average circularity of the toner particles having the diameters of at least 3 μm and less than 10 μm is in a range from about 0.968 to about 0.980.

4. The toner for developing an electrostatic latent image according to claim 1, wherein a volume average particle diameter is in a range from about 5 μm to about 10 μm.

5. The toner for developing an electrostatic latent image according to claim 1, wherein the percentage of toner particles having a particle diameter of up to about 4.0 μm is up to about 8%.

6. The toner for developing an electrostatic latent image according to claim 1, wherein a standard deviation of a volume distribution of the diameter of the toner particles is up to about 1.25.

7. The toner for developing an electrostatic latent image according to claim 1, wherein a standard deviation of each of the average aspect ratios D3, D4, D5, D6, D7, D8 and D9 is in a range from about 0.0190 to about 0.0233.

* * * * *